US005640723A

United States Patent [19]

Stanek

[11] Patent Number: 5,640,723

[45] Date of Patent: Jun. 24, 1997

[54] PORTABLE SHOWER STOOL WITH STORAGE COMPARTMENT

[76] Inventor: Michael Stanek, 1523 via Tulipan, San Clemente, Calif. 92673

[21] Appl. No.: 592,786

[22] Filed: Jan. 26, 1996

[51] Int. Cl.[6] ..... A47K 3/12

[52] U.S. Cl. ..... 4/578.1; 4/548; 4/571.1; 297/188.1

[58] Field of Search ..... 4/578.1, 579, 548, 4/549, 551, 571.1, 611; 297/461, 188.08, 188.09, 188.1; D6/524, 336, 349

[56] References Cited

U.S. PATENT DOCUMENTS

| | | | |
|---|---|---|---|
| D. 287,075 | 12/1986 | Colin et al. | D6/349 |
| 2,113,648 | 4/1938 | Delaney | 4/4 |
| 2,714,725 | 8/1955 | Boone | 4/148 |
| 3,900,902 | 8/1975 | Jarosinski | 4/611 |
| 4,527,830 | 7/1985 | Meyers | 297/188.09 |
| 5,076,405 | 12/1991 | Modica | 297/188.1 |
| 5,185,892 | 2/1993 | Mitchell | 4/578 |

FOREIGN PATENT DOCUMENTS

| | | | |
|---|---|---|---|
| 276681 | 10/1951 | Switzerland | 4/579 |

*Primary Examiner*—Henry J. Recla
*Assistant Examiner*—Charles R. Eloshway
*Attorney, Agent, or Firm*—Gene Scott—Patent Law & Venture Group

[57] ABSTRACT

A shower or bath stool having a storage area for items used in the toilet provides four non-skid legs, a movable top seating surface, and a storage space within. A series of vents and drain holes is provided so as to assure rapid drying and low humidity maintenance within the storage space. A grooming aids mount provides facility for hanging items such as a toothbrush, and a compartment for storing small items such as an electric shaver is provided. The top cover provides a convex surface for shedding water and a peripheral flange for directing the water away from the stool and for shielding the ventilation holes. Slots in the peripheral flange are used for hanging washcloths and such.

9 Claims, 2 Drawing Sheets

PORTABLE SHOWER STOOL WITH STORAGE COMPARTMENT

BACKGROUND OF THE INVENTION

1. Field of The Invention

This invention relates generally to chairs and stools, and more particularly to an improved stool for sitting in a shower, the stool providing storage for items useful while using the shower.

2. Description of Related Art

Invention and use of foot stools, seats and sitting devices is generally well known to the public. For example Colin et al teaches a combined portable shower stall foot stool and storage compartment in U.S. Pat. No. Des. 287,075. This document clearly shows several embodiments of a stool having a side wall, internal partitioned storage area, and a top surface which may support a foot or a body. An attached tub and shower seat of Mitchell is described in U.S. Pat. No. 5,185,892 and includes a seat portion, a folding leg for supporting the seat portion when in the horizontal orientation, and a folding wall bracket for supporting the entire apparatus when folded against a wall for storage or walking clearance. The device is folded out for sitting upon when in the shower or bath. Boone, U.S. Pat. No. 2,714,725 describes a bath cabinet providing an enclosed seat, side walls, storage drawers and racks for hanging towels. Delaney, U.S. Pat. No. 2,113,648 teaches a combination washbasin and cabinet attachment for bathtubs. This apparatus provides for storage in the shower compartment and may be used also for support of the feet or body.

The above described art is representative of inventions designed for meeting the objective of providing a safe and comfortable seating and resting surface while cleaning the body and its parts. However, these inventions do not provide item specific storage means for those things most frequently used in the bath or shower stall. Lacking, too, are the necessary safety features for use in a wet environment and the necessary construction for air drying of items and surfaces exposed to high humidity. Neither alone or in combination do we find a suitable construct for meeting the needs of those living in confined spaces and using small bath facilities.

The present invention fulfills these needs and provides further related advantages as described in the following summary.

SUMMARY OF THE INVENTION

The present invention is an improved foot and body support stool having many advantages over the prior art including the ability to store specific items used in the bath and shower area without these items becoming damaged from corrosion or mildew. It is clear that such an apparatus is generally lacking, in that we find a condition of clutter in most home bath facilities. The commercial availability and promotion of a great many bath and personal hygiene related products in recent years has caused the purchase of such a quantity of items for the bath that there is a significant storage problem in most homes. Just the many highly specific hair grooming products alone has made the typical bath area a veritable nightmare of bottles, tubes, cartridges, boxes and many other items. A storage solution is necessary. Also, it has become common to brush and floss ones teeth and even shave right in the shower. The very few horizontal surfaces available around the standard tub and shower stall enclosure are wholly inadequate for storing soap, shampoo, hair conditioner, shaver, toothbrush and toothpaste and so on. A storage compartment for use in the shower must have certain characteristics in order to prevent mold and mildew from forming on items stored within. The present invention provides a horizontal cover with a non-skid surface upon which any part of the anatomy may be rested. The surface provides a specific shape and high friction covering so that it is safe to use even when wet and covered with a soap film. The surface is supported by a frame having four legs for good stability. The cover and frame are provided with ventilation holes of a frequency and orientation so as to allow the entire device to be constantly flushed by air currents as they move within the room. This provides for evaporation of water drops and high local high humidity so that mildew cannot form or be caused to attack the various objects which can be stored within the device. A storage container is provided and the frame is adapted for its support within the itself. The storage container itself is vented to provide for rapid water and humidity clearing. It is an object of the present invention to provide a safe and easily ported stool for use in the shower. It is another object to provide such a stool which contains sufficient storage space so as to hold the items necessary for convenient personal hygiene while in the shower. It is another object of the invention to provide sufficient air movement within the stool and especially the storage area of the stool so that drying will occur rapidly to prevent mildew, mold and corrosion from forming on the device and its contents. It is a final object of the instant invention to provide such a stool as described herein which is light weight, easy to move about, is strong and sturdy and will not slip and slide on a wet and soapy floor surface.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a shower stool for storing grooming aids. In such drawings.

DETAILED DESCRIPTION OF THE PREFERRED EMBODIMENT

Figure 1:
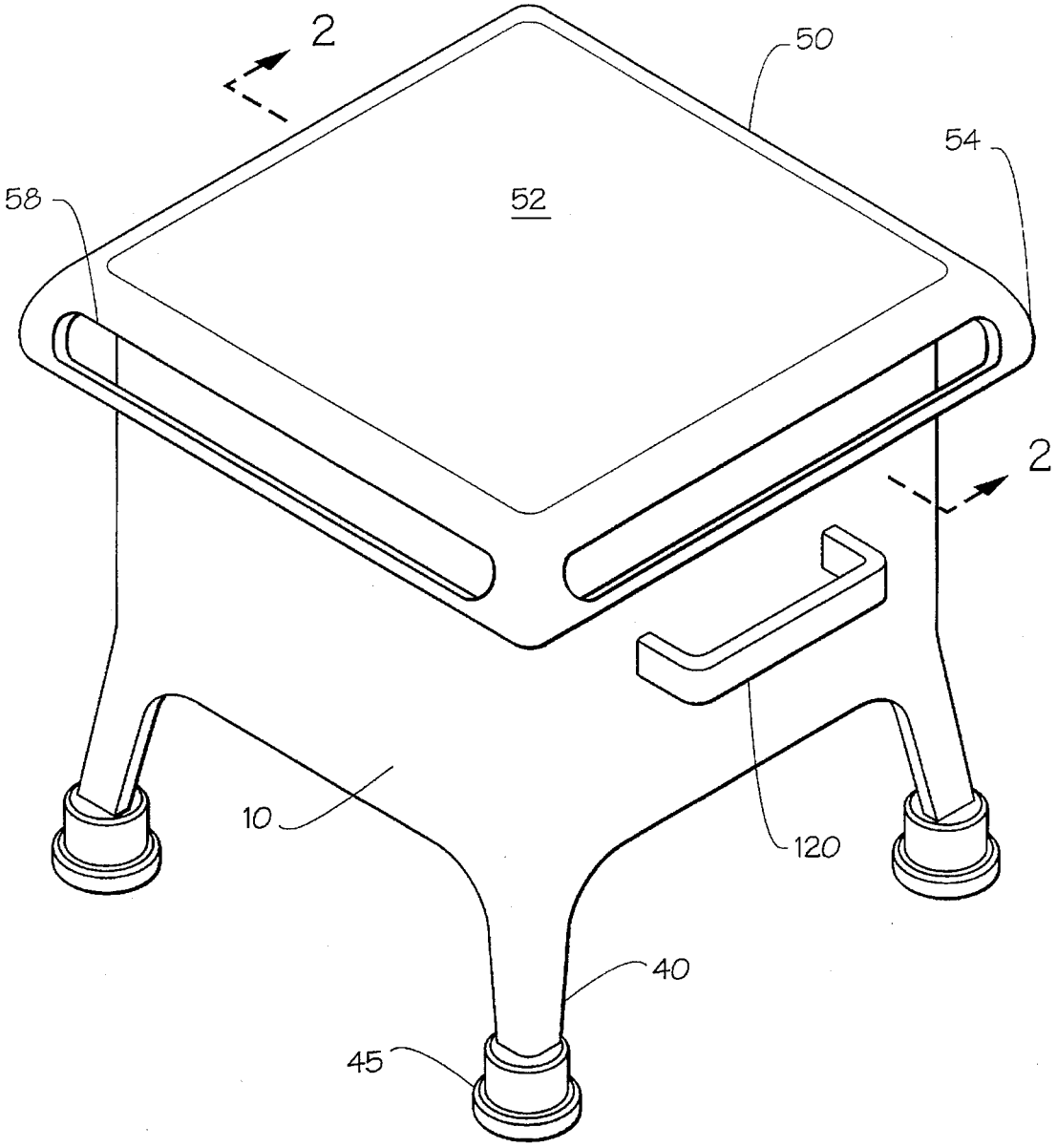
FIG. 1 is a perspective view of the preferred embodiment of the present invention showing a top cover of the invention in a closed position.
Figure 2:
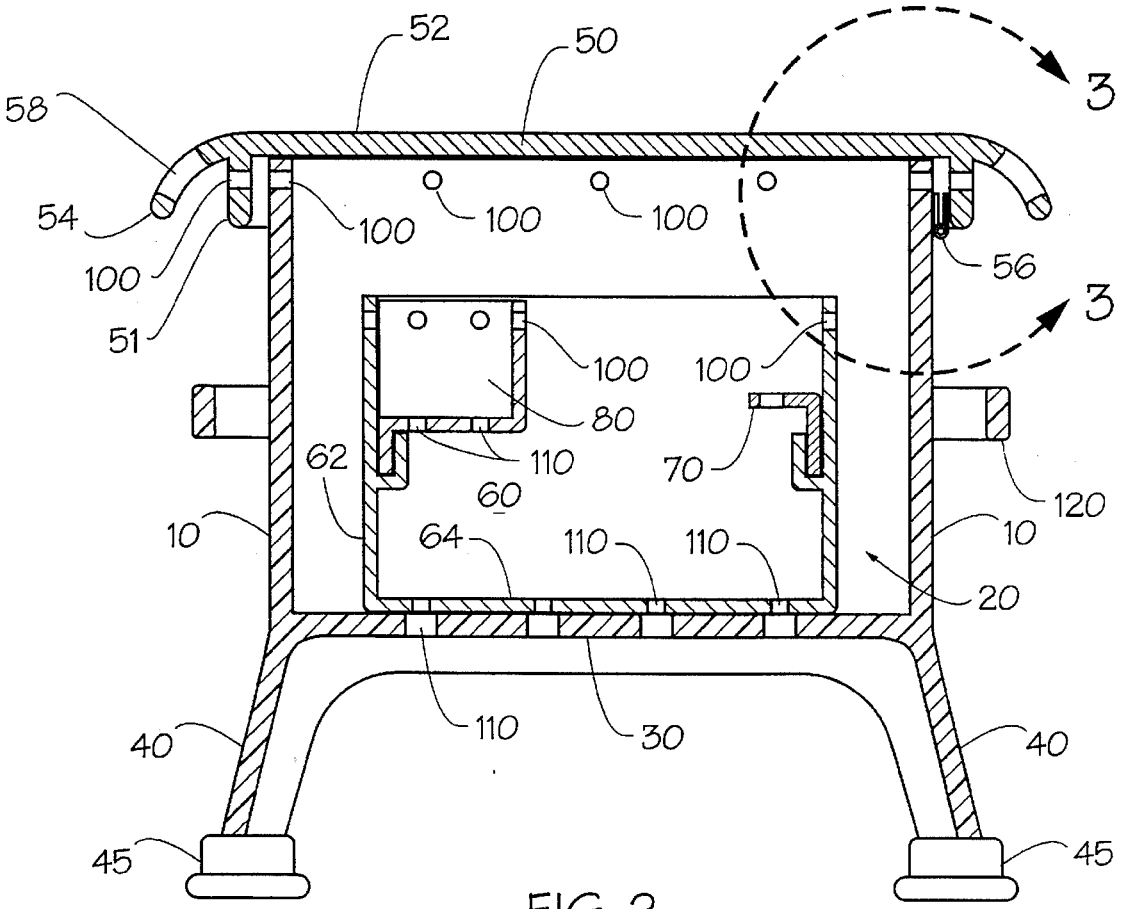
FIG. 2 is an elevational cross-sectional view thereof taken along cutting line 2—2 of FIG. 1, particularly showing interior details of the invention.
Figure 3:
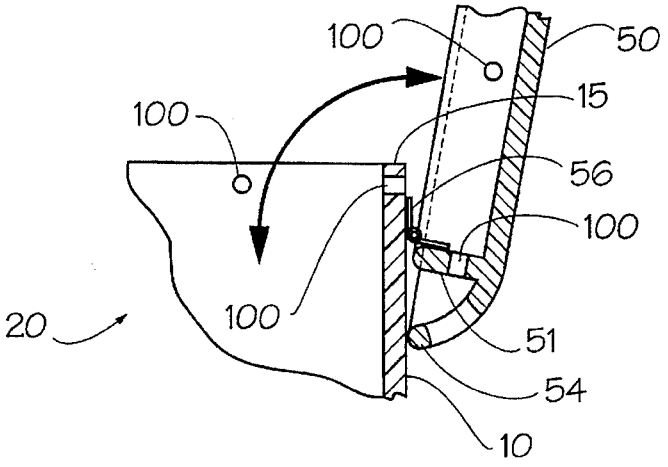
FIG. 3 is a partial view taken from the upper right corner of FIG. 2 showing the top cover of the invention in an open position.

The above described drawing figures illustrate a combination shower stool and a means for storing grooming aids. Details of the combination, as best shown in FIG. 2 include a side wall 10 enclosing a storage space 20. A horizontal structural member 30 is formed integrally with the side wall 10 and further encloses the storage space 20. A set of four legs 40 extend downwardly from the sidewall 10 and horizontal structural member 30 for supporting the stool on a support surface such as a shower stall or bathtub floor (not shown). Each of the legs 40 preferably terminates with an oversized boot 45 made of a non-slip material such as a rubber. A movable horizontal top cover 50 is positioned on top of the side wall 10 and is supported on it by the side wall's upfacing lip 15 as best seen in FIG. 3. The cover 50 further encloses the storage space 20 below it. Top cover 50 provides a flange 51 closed on the sidewall 10 so that the top 50 is snugly fitted on the stool, and so that water cannot move into the interior storage space 20. Cover 50 is preferably pivotally attached to the side wall 10 by a hinge 56, such as a piano hinge, so that the top 50 may be tilted upward about the hinge 56 to provide access to the storage space 20 below it as shown in FIG. 3. The cover 50 provides an upfacing convex surface 52 and a peripheral, downwardly directed, flange 54 extending outwardly over the side wall 10 for directing water away from the stool. It has been found that if the width and length dimensions of the stool are each approximately equal to the height, the stool has a relatively low center of gravity and is not easily upset or turned over when an unbalanced weight is applied to the surface 52. Therefore these proportions are considered part of the best mode of the invention. The legs 40 extend slightly outwardly from the side wall 10 to help improve the stability of the stool as well. The side wall 10, and the flange 51 of top cover 50 have a plurality of correspondingly aligned ventilation holes 100 in them so that air flow is able to move freely through the space 20 to dry it and to maintain it in a dry state. Furthermore the horizontal structural member 30 provides a plurality of drainage holes 110 for the same purpose. The ventilation and drainage holes 100, 110 have been found to be critical to the successful use of the present invention since they allow the interior space 20 to dry.

A means for storing 60 the grooming aids, such as a small compartment, is held within the storage space 20, and in one possible embodiment, is removable from it. Additionally, at least one mounting means 70, preferably a rack, for holding at least one of the grooming aids, such as a toothbrush or a water cup, is mounted within the storage space 20 as well. The storing means 60 provides a plurality of the ventilation holes 100 and the drainage holes 110 so that the storing means 60 is kept dry. It has been found that if handles 120 are placed in opposing positions on the exterior of the side wall 10 the instant invention is more easily lifting and moved. Since the invention must be moved frequently in many applications, such handles are considered to be critical to the success of the invention for without these handles, lifting by the edges of the top is often attempted with disastrous results. Positioned in the peripheral flange are elongated, horizontal slots 58 for mounting a washcloth 59, or the like, in order to hang these washing aids for drying them, as shown in FIG. 2.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination stool and grooming aids storage facility for use in a shower, the combination comprising:

a horizontal floor member;

a sidewall integral with the floor member and extending upwardly therefrom for enclosing a storage area, said sidewall having a plurality of ventilation holes therein;

a set of four legs extending downwardly from said sidewall for supporting said stool on a support surface;

a stool seat for selectively covering said storage area and providing access to said storage area, said seat being removably supported in a horizontal covering position by an upfacing lip extending from said sidewall;

said seat further having a plurality of ventilation holes therein which align with said ventilation holes in said sidewall when said seat is in said horizontal covering position;

a peripheral flange extending downwardly from said seat for shielding said ventilation holes from shower spray; and, at least one means for holding grooming aids within said storage area.

2. The stool of claim 1 further including at least two opposing positioned handles connected to said sides for lifting the stool.

3. The stool of claim 1 wherein the holding means of the storing area is a rack providing at least one aperture for engaging a grooming aid.

4. The stool of claim 2 wherein the holding means includes at least one compartment for storing a grooming aid.

5. The stool of claim 4 wherein the at least one compartment provides a plurality of ventilation holes therein and further provides a plurality of drainage holes therein.

6. The stool of claim 1 wherein the stool seat is pivotally attached to the side wall by a hinge, the stool seat tilting upward about the hinge to provide access to the holding means.

7. The stool of claim 1 wherein each of the legs terminates with a boot made of a non-slip material.

8. The stool of claim 1 wherein the stool seat provides an upfacing convex, non-slip surface.

9. The stool of claim 1 wherein the width and length dimensions of the stool are each approximately equal to the height dimension of the stool.

* * * * *